US008166861B2

(12) United States Patent
Peterson et al.

(10) Patent No.: US 8,166,861 B2
(45) Date of Patent: May 1, 2012

(54) SHOCK REDUCTION MUZZLE BRAKE

(75) Inventors: William S. Peterson, Tucson, AZ (US); Matthew A. Offolter, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 166 days.

(21) Appl. No.: 12/726,418

(22) Filed: Mar. 18, 2010

(65) Prior Publication Data

US 2011/0226121 A1 Sep. 22, 2011

(51) Int. Cl.
*F41A 21/36* (2006.01)

(52) U.S. Cl. ..... 89/14.3

(58) Field of Classification Search ..... 89/14.2, 89/14.3, 14.4; 42/1.06
See application file for complete search history.

(56) References Cited

U.S. PATENT DOCUMENTS 1,363,058 A * 12/1920 Schneider ..... 89/14.3
1,390,658 A * 9/1921 Towson ..... 89/14.3
1,901,138 A * 3/1933 Barnes ..... 89/14.3
4,436,017 A 3/1984 Mohlin
6,308,608 B1 * 10/2001 Eisenman ..... 89/14.3
6,578,462 B1 6/2003 Franchino et al.
7,296,505 B2 11/2007 Balbo et al.
7,600,461 B1 10/2009 Cler et al.

OTHER PUBLICATIONS

Carlucci et al., "Ballistics, Theory and Design of Guns and Ammunition," Vincennes University, Shake Learning Resources Center, Vincennes, IN 47591-9983, pp. 158-159.

* cited by examiner

*Primary Examiner* — Bret Hayes
(74) *Attorney, Agent, or Firm* — Renner, Otto, Boisselle & Sklar, LLP

(57) ABSTRACT

A shock reduction muzzle brake 100 for the muzzle end of a gun barrel 106 (i) maintains sufficient rearward-facing surface area in the path of the expanding propellant gas to counter the recoil, while also (ii) guiding shock waves away from a path of a projectile 104 and (iii) decreasing the rate of base decompression to minimize decompression shock. The muzzle brake 100 includes (a) a tube 102 that defines a path for a projectile 104, and (b) multiple forwardly-inclined holes 122 extending through the side wall 116 of the tube 102 to divert propellant gases away from the path of the projectile 104. The forwardly-inclined holes 122 have an outlet of that is closer to the forward end 114 of the tube 102 than the inlet of the hole 122, thereby limiting the surface area that could reflect shock waves back onto the projectile 104. The holes 122 are sized to slow release of the base pressure to minimize decompression shock.

20 Claims, 8 Drawing Sheets

SHOCK REDUCTION MUZZLE BRAKE

FIELD OF THE INVENTION

This invention relates to the field of large caliber weapons, particularly artillery weapons, where recoil forces are a major concern. More specifically, the invention relates to muzzle brakes as applied to large caliber guns and to the use of those brakes in the control of recoil forces during firing.

BACKGROUND

Large caliber weapons deliver relatively large, heavy projectiles at relatively high velocities to distant targets. When the weapon is fired, a propellant burns and hot gasses rapidly expand in volume inside a gun barrel. The expanding gases accelerate a projectile along the length of the tubular barrel, ejecting the projectile at a high velocity from the muzzle end of the barrel. The expanding propellant gasses follow the projectile and are expelled into the atmosphere at velocities equaling or even exceeding those of the projectile, similar to an exhaust plume from a rocket. The combination of accelerating the projectile and the propellant gasses exiting the muzzle end of the gun barrel produces a large breach-directed recoil thrust (also called a recoil force or simply recoil) that is transmitted to the support structure.

Gun designers take these recoil forces into consideration during the design process, using physics principles related to conservation of momentum to predict the forces involved. Larger recoil forces generally require heavier and stronger gun components and support structures, both of which generally are more expensive. Smaller and lighter guns and support structures are not only less expensive, but they are easier to transport, which is another important consideration for gun designers.

Consequently, gun designers generally try to mitigate the recoil, and thus reduce the forces transmitted from the gun barrel to the support structure by installing or integrating a muzzle brake at or near the muzzle end of the gun barrel. A muzzle brake generally reduces the momentum of the recoiling components of a gun by diverting the flow of propellant gasses in a way that produces forces to counter the breach-directed recoil.

An early form of muzzle brake includes a series of holes drilled radially into the tubular gun barrel or an attachment to the barrel at the muzzle end. This design is sometimes referred to as a "pepper pot." In other forms the muzzle brake may have a series of baffles perpendicular to the gun barrel axis or angled backward so that the outlet is closer to the breach end of the gun barrel than the inlet. The diverted high pressure gasses exert a force on the rearward-facing surfaces of the baffles that counteracts the recoil force created by the exhaust of the propellant gasses and the acceleration of the projectile.

SUMMARY OF THE INVENTION

The present invention is directed to a shock reduction muzzle brake for the muzzle end of a gun barrel. Upon firing a gun, rapidly expanding propellant gases accelerate a projectile along the gun barrel. As the projectile exits the barrel and passes through the muzzle brake, the de-accelerating projectile generates shock waves. These shock waves can reflect off surfaces in the gun barrel and the muzzle brake back onto the projectile. "Smart" projectiles have electronic components that typically are used to help guide the projectile more accurately to its target. These electronic components are more sensitive to shock waves, which can damage the electronic components and prevent them from performing in their intended manner.

Unlike current muzzle brake designs that reflect shock waves back onto the projectile, the present invention minimizes or eliminates these reflected shock waves. The muzzle brake provided by the invention also reduces base decompression shock on the back (base) of the projectile by increasing the decompression time and thus decreasing the magnitude of the shock wave impacting the projectile from behind as it exits the gun barrel. Reducing the shock wave also reduces tip-off (pitch and yaw) by reducing unsymmetrical forces acting on the projectile. Like previous muzzle brakes, the muzzle brake provided by the invention also reduces the recoil force transmitted to the support structure by maintaining sufficient rearward-facing surface area in the path of the propellant gases to generate a force in a forward direction to counter the rearward-acting recoil forces.

Unlike prior muzzle brakes, the shock reduction muzzle brake provided by the present invention directs the propellant gasses out of the muzzle brake without reflecting shock waves back onto the projectile as it travels through the muzzle brake. The propellant gasses enter the rear of the muzzle brake and as the gasses advance through the muzzle brake some of the gas is redirected outward and against sufficient surface area to maintain the recoil capability without reflecting the shock waves back inward into the muzzle brake and onto the projectile.

Prior muzzle brake designs also tend to use large openings that allow the pressure on the base of the projectile to decompress quickly. This creates a decompression shock on the projectile when the pressure is released. Rather than a few large openings, the muzzle brakes provided by the invention have a multitude of smaller openings so that the propellant gases are exhausted more slowly and the pressure is reduced more gradually without a sudden shock.

In one embodiment provided by the invention, a shock reduction muzzle brake includes (a) a tube that defines a path for a projectile, and (b) multiple forwardly-inclined holes extending through the side wall to divert propellant gases away from the path of the projectile, where an outlet of each hole is closer to the forward end of the tube than the inlet of the hole. The tube has a longitudinal axis extending from a rear end to a forward end, and the tube defines the side wall extending between the rear end and the forward end.

Other embodiments of the muzzle brake can include one or more of the following features: (i) where the side wall of the tube has a substantially smooth inside surface that is interrupted by flow-redirecting protrusions that extend approximately 0.1 inch (approximately 0.25 centimeter) to approximately 0.5 inch (approximately 1.3 centimeters) from the inside surface toward the axis of the tube; (ii) where the side wall of the tube includes approximately one hole per inch (approximately two-and-a-half centimeters) of length of the tube to approximately one hole per six inches (approximately fifteen centimeters) of length of the tube; and (iii) where the side wall of the tube has approximately 10% to 70% of inlet openings to the holes per unit length of the tube.

An exemplary embodiment of the muzzle brake includes a cylindrical tube with a constant inside diameter, and the propellant exhaust ports or holes through the side of the tube are inclined relative to the center line of the tube at an angle that is less than 90° with respect to the forward end of the tube. Since the holes are sloped in the forward direction relative to the axis of the gun barrel, the shock wave reflects outward rather than back into the barrel where it can impact the projectile.

According to another embodiment, the inside diameter of the muzzle brake is not constant but progressively expands toward the forward end of the tube. Small flow re-directors, which are protrusions extending inwardly from the inside surface of the tube toward the central axis, can be provided to help re-direct propellant gasses out the exhaust ports.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

DETAILED DESCRIPTION

Turning now to the drawings and a detailed description of exemplary embodiments of the invention, our invention provides a shock reduction muzzle brake 100 (FIG. 5) that generates a reaction force to counter recoil forces, while also minimizing or eliminating the shock waves and related effects created by prior muzzle brake designs. Prior muzzle brake designs often reflect shock waves back onto the projectile as it passes through the muzzle brake and also vent propellant gases so rapidly that the decompression effects on the base of the projectile can damage the electronic components of a smart projectile. The muzzle brakes provided by the invention have multiple, relatively small propellant gas exhaust ports that vent the pressurized propellant gases relatively slower to reduce the rate of decompression on the base of the projectile, and the propellant gas exhaust ports are forwardly-inclined to direct shock waves away from the path of the projectile.

Figure 1:
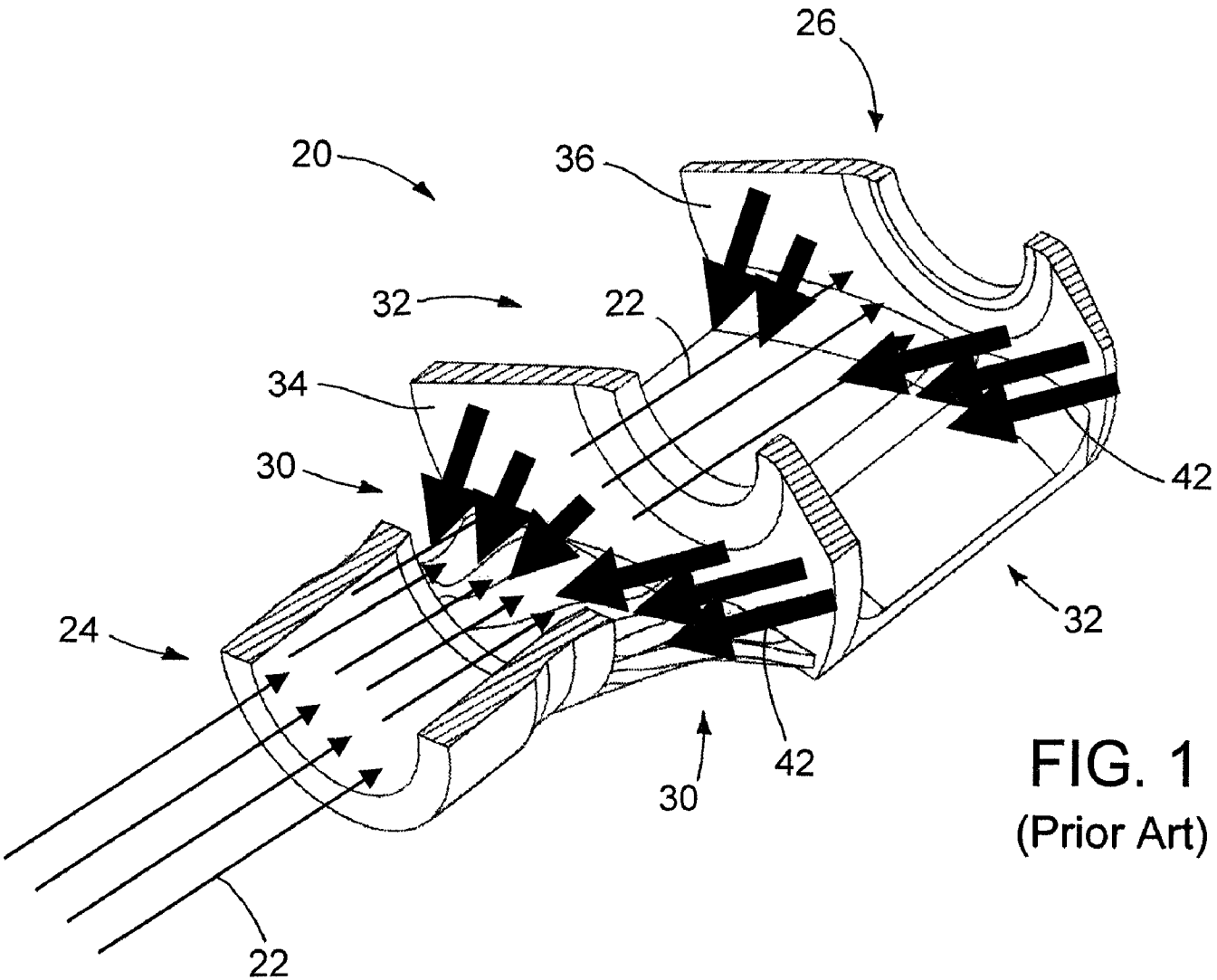
FIG. 1 (Prior Art)
FIG. 1 is a perspective cross-sectional view of a known muzzle brake in the prior art.

As mentioned above, rapidly decelerating the projectile creates shock waves that can reflect off surfaces of the muzzle brake and damage electronic components of a smart projectile. FIG. 1 illustrates how propellant exhaust gases and shock waves travel through a conventional muzzle brake 20, in the direction of the smaller arrows 22. The propellant gases and projectile enter at a rear end of the muzzle brake and travel in a forward direction toward a forward end of the muzzle brake. To satisfy its primary function, the muzzle brake 20 provides relatively large openings 30 and 32 to rapidly exhaust the pressurized propellant gases against sufficient rearward-facing surface 34 and 36 area to generate forward-directed forces on the muzzle brake 20, and the gun barrel to which the muzzle brake 20 is attached, to counter recoil forces. These forces counter the recoil forces generated in accelerating the projectile and exhausting the propellant gases from the gun barrel. Unfortunately, in conventional muzzle brakes, including the muzzle brake 20 of FIG. 1, shock waves can reflect off these rearward-facing surfaces back onto the projectile, as illustrated by the larger arrows 42.

Although generally not considered to present a problem for conventional "dumb" projectiles, the electronic components in "smart" projectiles are more sensitive to shock waves. Consider FIG. 2, for example, which illustrates the large accelerations that occur as the projectile exits the muzzle of the gun barrel and enters the muzzle brake. The top, relatively darker and thicker line 50 represents the acceleration of a projectile along a gun barrel in the forward direction. The lighter lines 52 and 54 represent radial acceleration components. These accelerations indicate large magnitude and erratic forces acting on the projectile as it passes through the conventional muzzle brake and decelerates. Reflected shock waves, as well as the rapid decompression due to the relatively large exhaust ports in previous muzzle brakes, can damage or destroy these electronic components.

Figure 2:
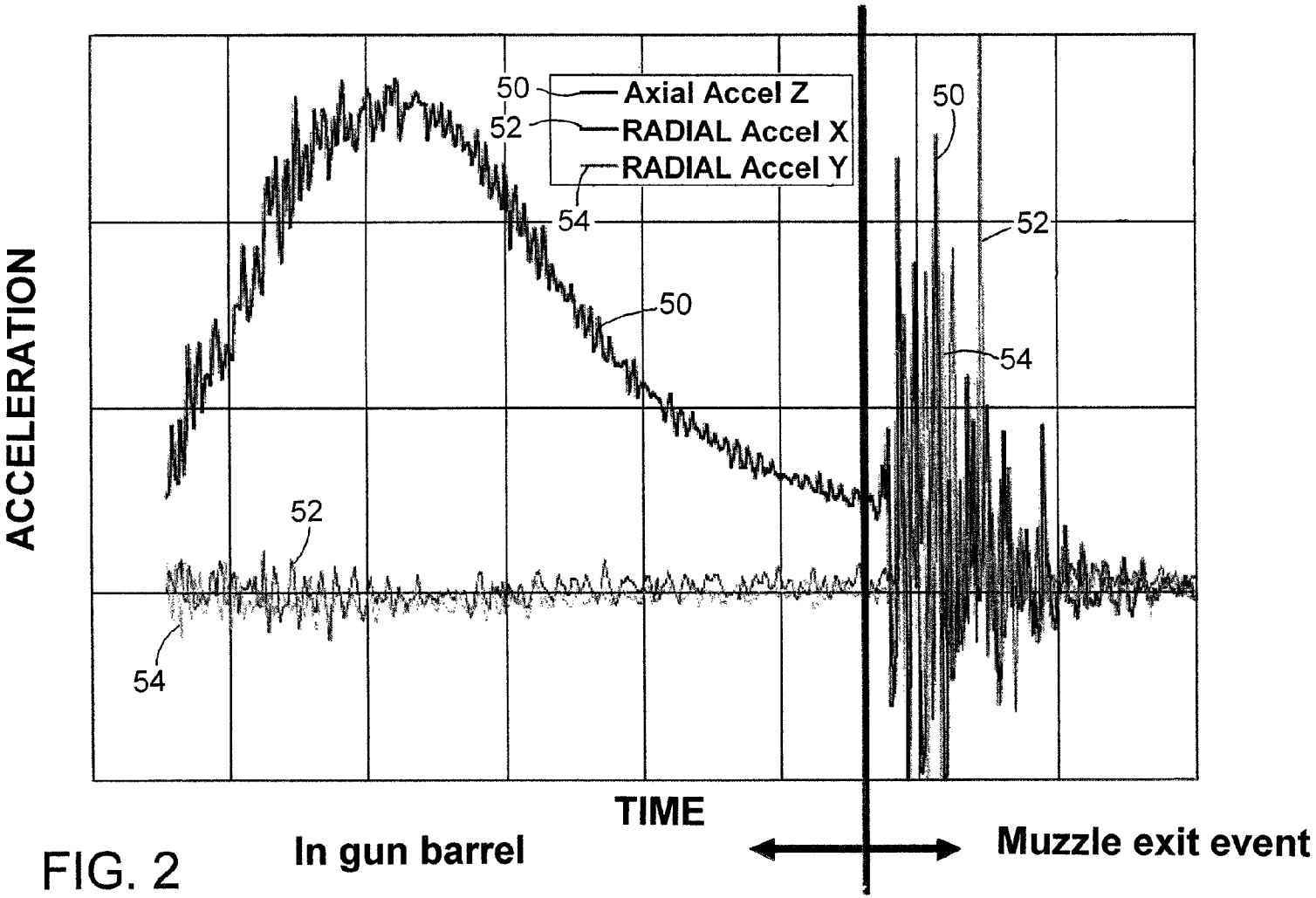
FIG. 2 is a graphical representation of the shock waves generated in firing a gun with a conventional muzzle brake.
Figure 3:
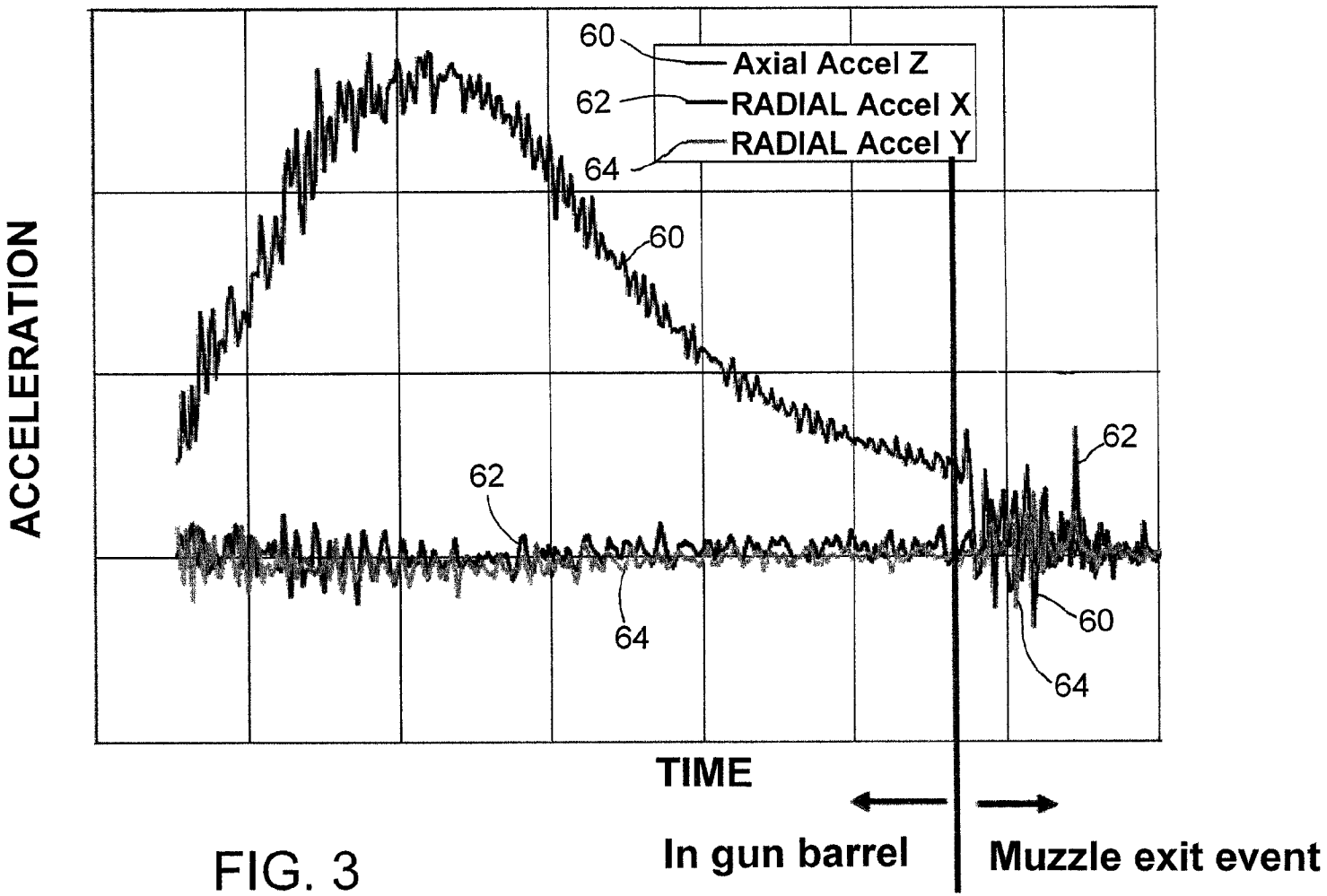
FIG. 3 is a graphical representation of the shock waves generated in firing a gun with a muzzle brake provided by the present invention. Notice the decrease in shock loading at the muzzle exit event.

Like previous muzzle brakes, the shock reduction muzzle brake provided by the invention reduces the recoil force transmitted to the support structure by maintaining sufficient rearward-facing surface area in the path of the propellant gases to generate forces in an opposing direction. Unlike prior muzzle brakes, however, the shock reduction muzzle brake provided by the invention directs the propellant gasses out of the gun barrel without reflecting shock waves back onto the projectile. The result is shown in FIG. 3, which in comparison to FIG. 2 shows a significant decrease in the acceleration spikes imparted to the projectile as it exits the muzzle end of the gun barrel, where lines 60, 62 and 64 correspond to lines 50, 52 and 54 of FIG. 2.

Prior muzzle brake designs tend to use large openings that allow the pressure in the muzzle brake to decompress quickly, which creates a mechanical shock at the base of the projectile when the pressure is released. Rapid pressure release creates a base decompression shock on the back (base) of the projectile. Rather than a few large openings, the present invention provides a multitude of smaller openings so that the propellant gases are exhausted more slowly and the pressure is reduced more gradually without a sudden shock.

Figure 4:
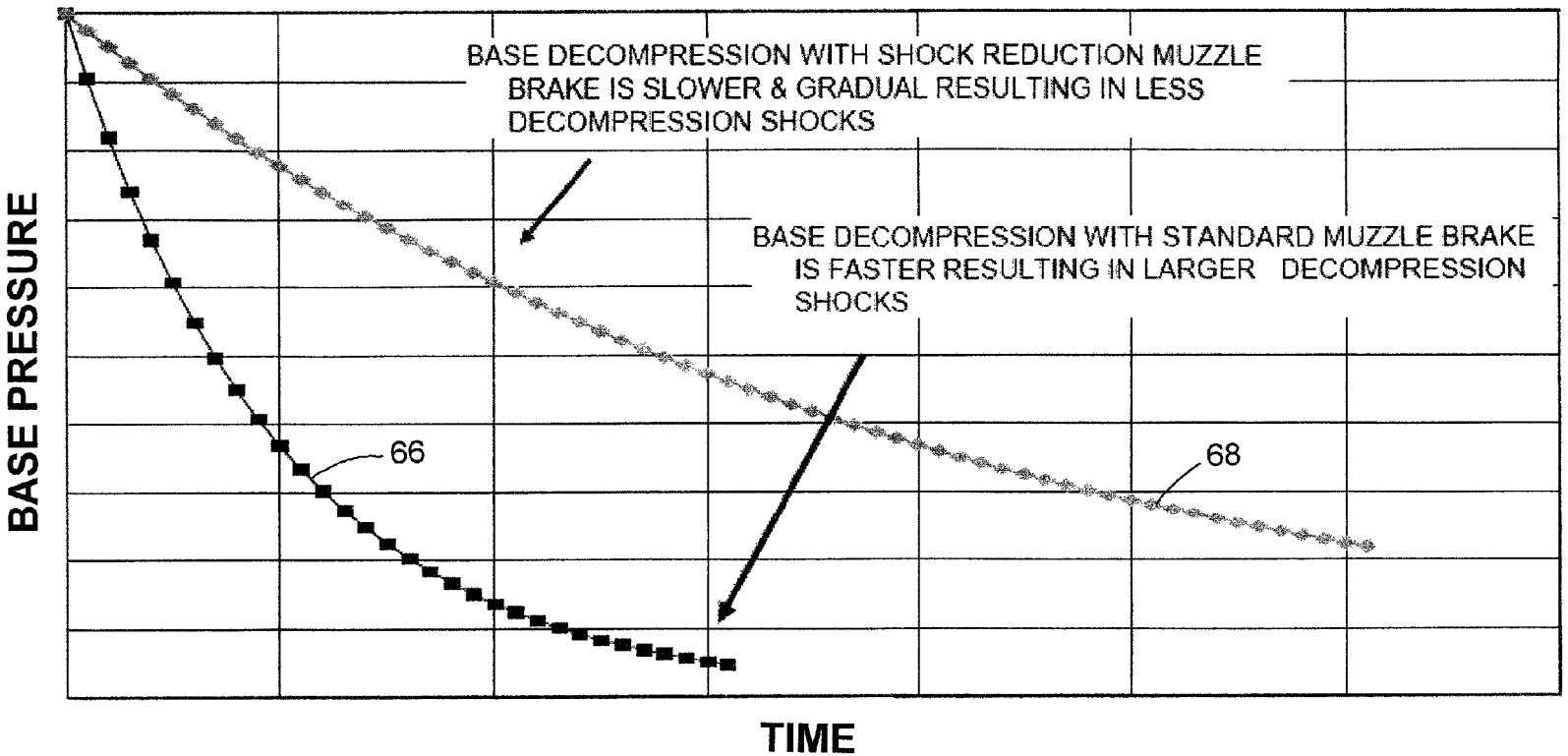
FIG. 4 is a graphical representation of the base decompression over time for a known muzzle brake in comparison to a shock-reduction muzzle brake provided by the present invention.

By increasing the decompression time the shock reduction muzzle brake also decreases the magnitude of the shock wave impacting the projectile as it exits the gun barrel, as shown in FIG. 4, which compares the base decompression over time for a conventional muzzle brake 66 to the base decompression over time for the shock reduction muzzle brake 68. Reducing the pressure more slowly also reduces unsymmetrical forces acting on the projectile, thereby reducing tip-off (pitch and yaw) that lead to less accurate shots or require more correction by the electronically-controlled guidance elements of a smart projectile.

FIGS. 5-10 generally show a first embodiment of a shock reduction muzzle brake 100 provided by the invention. The shock reduction muzzle brake 100 provided by the invention includes a tube 102 that defines the general shape of the muzzle brake 100 and a path for a projectile 104, generally extending the path through the gun barrel 106. More particularly, the tube 102 has a longitudinal axis 110 extending from a rear end 112 to a forward end 114. The tube 102 defines a side wall 116 extending between the rear end 112 and the forward end 114 and the side wall 116 defines a path for the projectile 104 through the tube 102. A forward direction 120 is a direction extending parallel to the axis 110 of the tube 102 from the rear end 112 toward the forward end 114, and a rearward direction is opposite the forward direction. The length of the tube 102 is measured parallel to the axis 110 of the tube 102, generally in the forward direction.

The muzzle brake 100 also includes multiple forwardly-inclined holes 122 extending through the side wall 116 of the tube 102 to divert propellant gases and shock waves away from the path of the projectile 104. The axis of each hole 122 through the side wall 116 has an angle of less than 90° relative to the axis 110 of the tube, as measured on the forward side of the hole 122. In other words, an outlet of each hole 122 is closer to the forward end 114 of the tube 102 than the inlet of the hole 122, where the inlet is defined by an inlet opening in an inside surface 124 of the tube 102 and the outlet is defined by an outlet opening in an outside surface 126 of the tube 102.

The present invention is not limited to a muzzle brake 100 having a fixed number of holes 122. Typically, the side wall 116 of the tube 102 includes approximately one hole per inch (approximately two-and-a-half centimeters) of length of the tube 102 to approximately one hole per six inches (approximately fifteen centimeters) of length of the tube 102. The holes 122 should not be so large that the pressure drops too quickly, so the inside surface 124 of the side wall 116 of the tube 102 typically has openings that cover approximately 10% to 70% of the inside surface area, per unit length of the tube 102.

Figure 5:
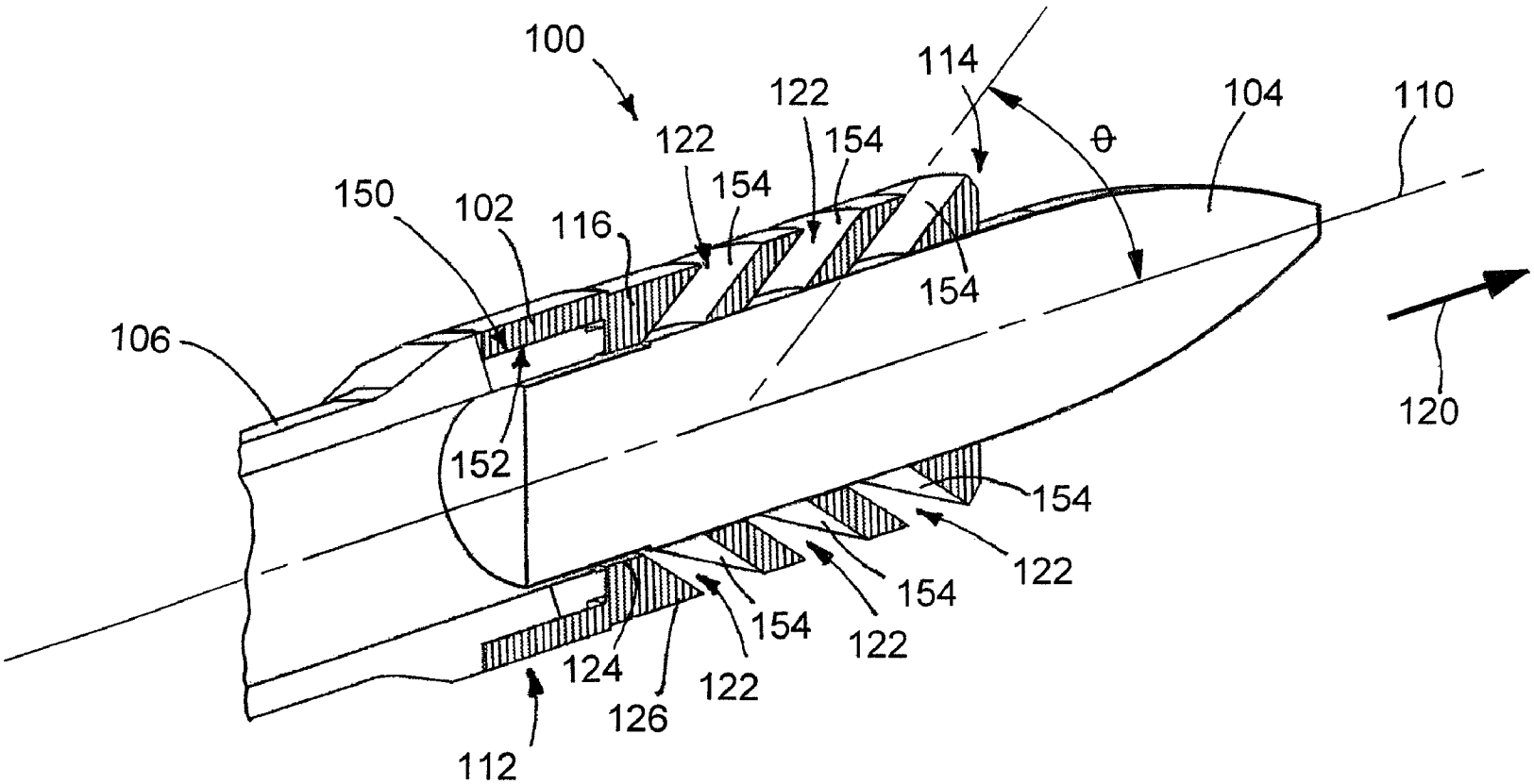
FIG. 5 is a perspective cross-sectional view of a projectile from a gun barrel passing through a muzzle brake provided by the present invention.
Figure 6:
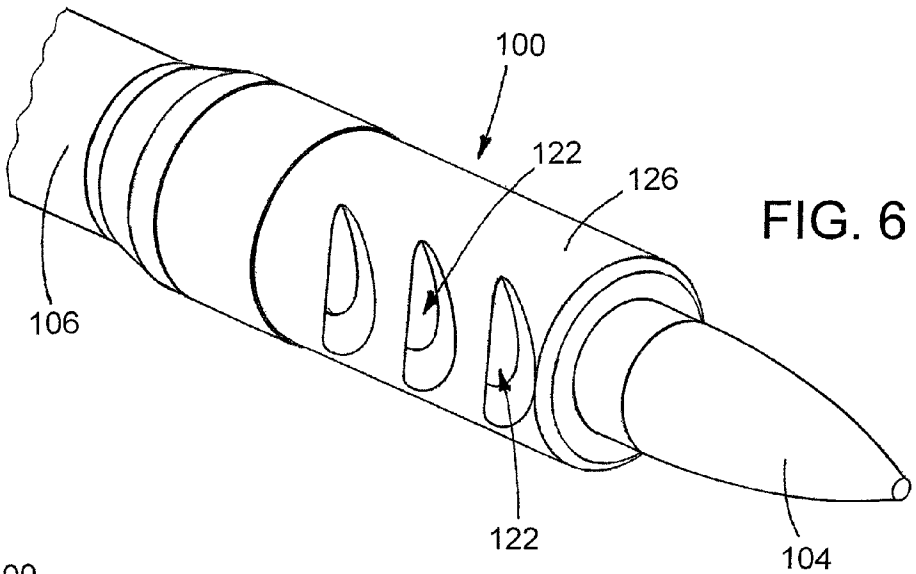
FIGS. 6 and 7 are perspective views of the muzzle brake shown in FIG. 5.
Figure 7:
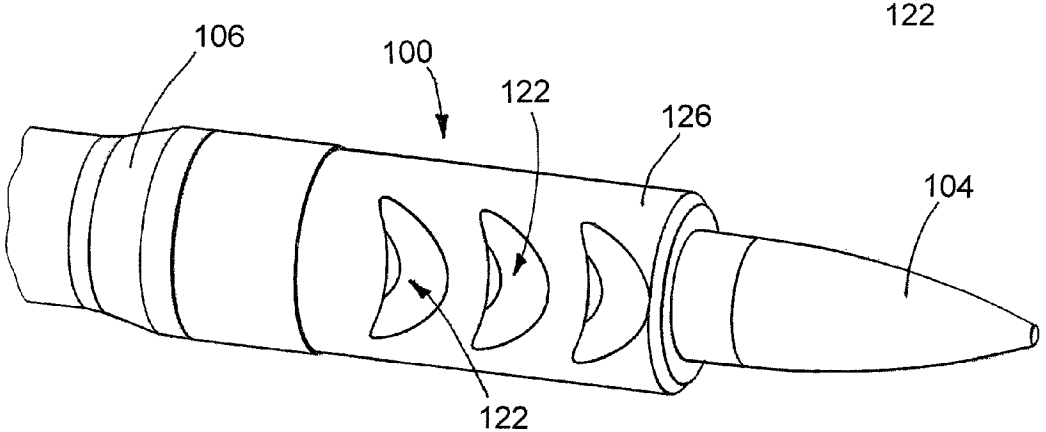

The muzzle brake 100 shown in FIGS. 5-7 includes a cylindrical tube 102 with a constant inside diameter. The inside diameter of the muzzle brake closely approximates the inside diameter of the gun barrel 106, which is slightly larger than the outside diameter of the projectile 104. This close fit between the inside diameter and the projectile 104 prevents pressurized propellant gases from escaping before accelerating the projectile 104. Most of the propellant gases are contained behind the projectile 104 as it accelerates through the gun barrel 106. As the projectile 104 passes through the muzzle brake 100, however, the propellant exhaust ports or holes 122 in the muzzle brake 100 allow some of the propellant gases to escape. Unlike previous muzzle brakes, however, these holes 122 are forwardly inclined or sloped relative to the longitudinal axis 110 through the center of the tube 102. Since the holes 122 are sloped relative to the axis 110 of the tube 102, shock waves traveling through the holes 122 reflect outward rather than back onto the projectile 104.

Figure 9:
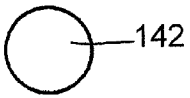
FIGS. 8-10 are angled views of exemplary hole geometries of propellant exhaust port holes for a muzzle brake provided in accordance the invention, as seen looking along a longitudinal axis of the hole.
Figure 8:
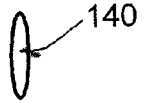
Figure 10:
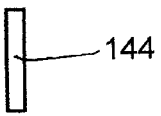

The propellant exhaust holes 122 passing through the side wall 116 of the tubular muzzle brake 100 can have a variety of different cross-sectional shapes. The holes 122 in the muzzle brake 100 of FIGS. 5-7 have a semi-circular cross-sectional shape or geometry when viewed along a longitudinal axis of a hole 102. As seen in FIGS. 8-10, other exemplary shapes include elliptical 140, circular 142, and rectangular 144. The holes also must be sized to provide the desired rate of decompression. The holes may have different sizes. Depending in part on the size of the gun for which the muzzle brake is designed, the holes can have a major dimension, such as a circular diameter or major ellipse dimension or major rectangular side length, between approximately one inch and approximately four inches (approximately two-and-a-half to five centimeters).

While the multiple holes can have different sizes, each of the holes generally has a constant cross-sectional area along its length. Although not shown in the figures, in some embodiments the holes can change sizes or shapes along their length. For a constant-size hole, the cross-sectional area of a hole 122 in the side wall 116 of the tube 102 is constant, and the area of the opening to the hole 122 in the inside surface 124 of the tube 102 is substantially the same as the area of opening to the hole 122 in the outside surface 126 of the tube 102.

To maintain uniform pressure across the projectile 104, the inlet openings in the inside surface 124 of the muzzle brake 100 are uniformly spaced about the circumference. Consequently, pairs of openings in the inside surface 124 of the side wall 116 preferably are diametrically opposed. In the illustrated embodiment the holes 122 are longitudinally aligned. Alternatively, the hole positions can be circumferentially rotated relative to longitudinally-adjacent holes 122 so that the holes 122 are not longitudinally aligned.

The muzzle brake 100 also includes means for securing the rear end 112 of the muzzle brake 100 to the muzzle end of a gun barrel 106 to transmit recoil-countering forces from the muzzle brake 100 to the gun barrel 106. Exemplary securing means includes mating screw threads, for example, with a threaded portion of the tube 102 mating with a corresponding threaded portion on a gun barrel 106. Alternative or additional means for securing the muzzle brake to a gun barrel are well known, including threads, clamps, screws, bolts, welds, etc. In this embodiment, the rear end 112 of the tube 102 includes a threaded portion 150 of the tube 102 that mates with a corresponding threaded portion 152 on the muzzle end of a gun barrel 106.

To provide the necessary recoil-countering force, the muzzle brake includes sufficient rearward-facing surface area 154 to interact with the propellant gases to generate the desired force in a forward direction to substantially counter the rearwardly-acting recoil force. Preferably, the combined rearward-facing surface area is sufficient to substantially counteract recoil forces created by the firing of a projectile 104 from a gun barrel 106 to which the muzzle brake 100 is connected.

Figure 11:
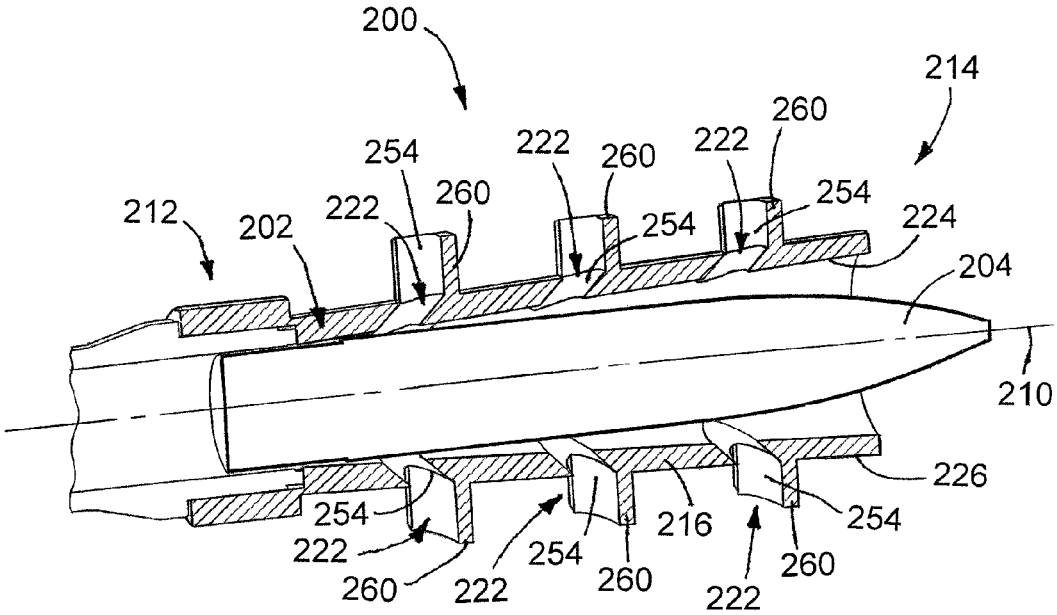
FIG. 11 is a perspective cross-sectional view of a projectile from a gun barrel passing through another embodiment of a muzzle brake provided by the present invention.
Figure 12:
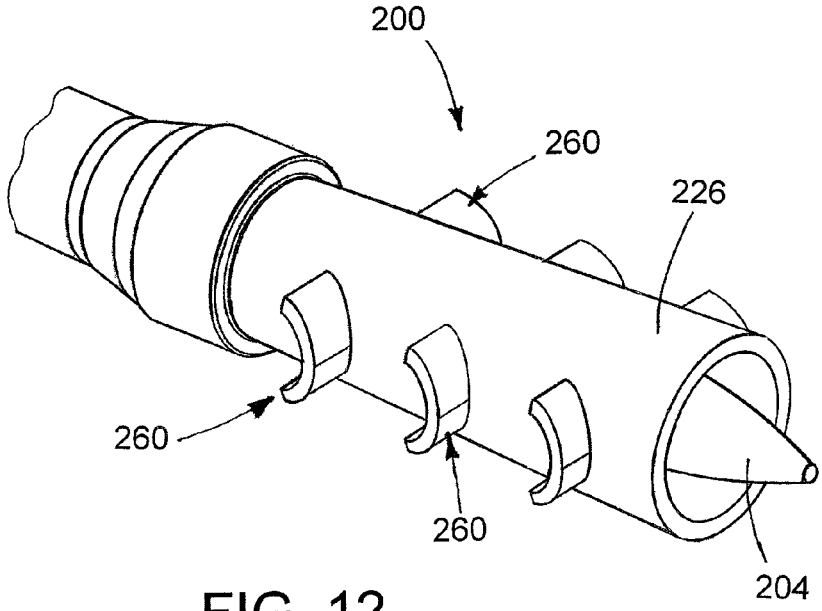
FIG. 12 is a perspective view of the muzzle brake of FIG. 11.

Although the inside diameter of the tube 102 is substantially constant between the rear end 112 and the forward end 114 of the tube 102 in the muzzle brake 100 embodiment shown in FIGS. 5-7, in the muzzle brake 200 embodiment shown in FIGS. 11 and 12 the inside diameter of the tube 202 progressively increases or expands in the forward direction 120 from the rear end 212 to the forward end 214 of the tube 202.

The muzzle brake 200 also includes means for redirecting gas flow to generate a force to counteract a recoil force. The redirecting means includes sufficient rearward-facing surface area 254 to interact with the propellant gases to generate the desired force in a forward direction to substantially counter the rearwardly-acting recoil force. The redirecting means in this embodiment includes at least one deflector vane 260 extending from an outside surface 226 of the side wall 216 of the tube 202 adjacent a forward side of a hole 222, as shown in FIGS. 11 and 12. The deflector vane 260 is positioned on a forward side of the outlet opening in the outside surface 226 of the tube 202. The deflector vane 260 generally extends along an axis that is less than or equal to 90° relative to the axis 210 of the tube 202. As shown, the deflector vane 260 is not planar, but rather is cupped or curved about an axis transverse the longitudinal axis 210 of the tube 202, presenting a concavely curved cross-sectional shape to the propellant gases exiting the hole 222.

Figure 14:
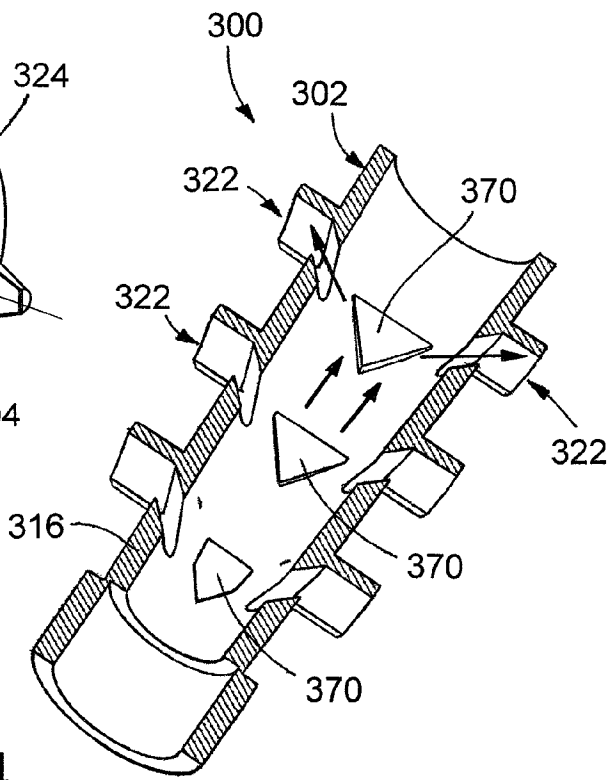
FIG. 14 is a perspective view of the muzzle brake of FIG. 11.
Figure 13:
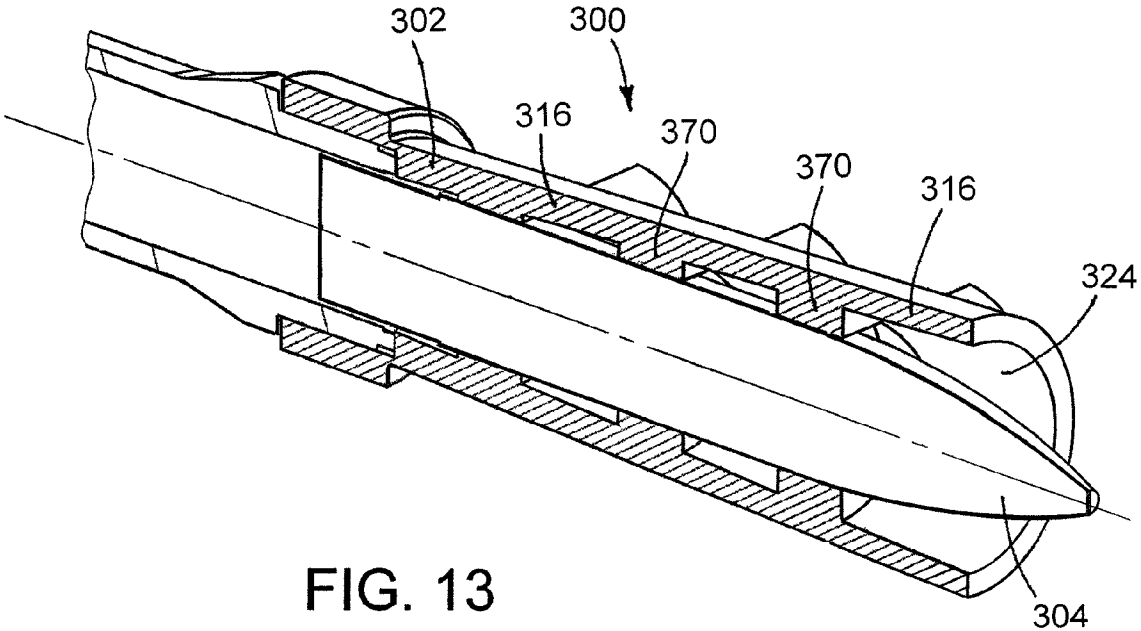
FIG. 13 is a perspective cross-sectional view of a projectile from a gun barrel passing through another embodiment of a muzzle brake provided by the present invention.

In the muzzle brake 100, 200 embodiments shown in FIGS. 5-7, 11 and 12, the side wall 116, 216 of the tube 102, 202 has a substantially smooth inside surface 124, 224. In another embodiment shown in FIGS. 13 and 14 the side wall 316 of the tube 302 has a substantially smooth inside surface that is interrupted by protrusions 370 that extend from the inside surface 324 toward the axis 310 of the tube 302. These protrusions 370 may be provided to help re-direct propellant gasses out the exhaust ports 322. The protrusions 370 are a means for redirecting gas flow and shock waves from the path of the projectile 304 toward an exhaust port 322. The redirecting means includes one or more protrusions or flow redirectors 370 that extend inwardly from an inside surface 324 of the side wall 316 of the tube 302 toward the axis 310 of the tube 302. These flow-redirecting protrusions 370 extend approximately 0.1 inch (approximately 0.25 centimeter) to approximately 0.5 inch (approximately 1.3 centimeters) from the inside surface 324 toward the axis 310 of the tube 302. An exemplary shape for the flow-redirecting protrusions 370 resembles one of a triangle, a diamond, a chevron, a helix, and a strake. These flow redirectors 370 redirect some of the propellant gases between exhaust port inlet openings toward those inlets, thereby decreasing pressure peaks between inlet openings.

In summary, an exemplary shock reduction muzzle brake provided by the invention includes (a) a tube that defines a path for a projectile and (b) multiple forwardly-inclined holes extending through the side wall of the tube to divert propellant gases away from the path of the projectile. The tube has a longitudinal axis extending from a rear end to a forward end and defines a side wall extending between the rear end and the forward end. Thus for each forwardly-inclined hole, an outlet of the hole on the outside surface of the tube is closer to the forward end of the tube than the inlet of the hole on the inside surface of the tube. The muzzle brake also can include one or more of the following features: (i) the side wall of the tube having a substantially smooth inside surface that is interrupted by flow-redirecting protrusions that extend approximately 0.1 inch (approximately 0.25 centimeter) to approximately 0.5 inch (approximately 1.3 centimeters) from the inside surface toward the axis of the tube; (ii) the side wall of the tube including approximately one hole per inch (approximately two-and-a-half centimeters) of length of the tube to approximately one hole per six inches (approximately fifteen centimeters) of length of the tube; and (iii) the side wall of the tube having approximately 10% to 70% of inlet openings to the holes per unit length of the tube.

Put another way, the invention provides a shock reduction muzzle brake for the muzzle end of a gun barrel (i) that maintains sufficient rearward-facing surface area in the path of the expanding propellant gas to counter the recoil, while also (ii) guiding shock waves away from a path of a projectile and (iii) decreasing the rate of base decompression to minimize decompression shock. The muzzle brake includes (a) a tube that defines a path for a projectile, and (b) multiple forwardly-inclined holes extending through the side wall of the tube to divert propellant gases away from the path of the projectile. The forwardly-inclined holes have an outlet of that is closer to the forward end of the tube than the inlet of the hole, thereby limiting the surface area that could reflect shock waves back onto the projectile. The holes are sized to slow release of the base pressure to minimize decompression shock.

Although the invention has been shown and described with respect to a certain illustrated embodiment or embodiments, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiment or embodiments of the invention.

We claim:

1. A shock reduction muzzle brake comprising (a) a tube that defines a path for a projectile, the tube having a longitudinal axis extending from a rear end to a forward end, the tube defining a side wall extending between the rear end and the forward end, (b) multiple forwardly-inclined holes, each hole extending from an inside surface of the side wall to an outside surface along an axis that has an angle of less than 90° relative to the longitudinal axis as measured on the forward side of the hole, the holes extending through the side wall to divert propellant gases away from the path of the projectile, and (c) at least one deflector vane extending from the outside surface of the side wall of the tube adjacent a hole and on a forward side of the hole, the deflector vane having a rearwardly-facing surface extending generally along an axis that has an angle of 90° or less relative to the longitudinal axis of the tube as measured on the forward side of the axis of the rearwardly-facing surface, the rearwardly-facing surface axis intersecting the axis of the hole at an angle that is less than 90° as measured on an inner side toward the outer surface of the side wall so that the rearwardly-facing surface faces outwardly to reflect shock waves exiting the hole away from the hole.

2. A muzzle brake as set forth in claim 1, where the side wall of the tube includes approximately one hole per inch (approximately two-and-a-half centimeters) of length of the muzzle brake to approximately one hole per six inches (approximately fifteen centimeters) of length of the tube.

3. A muzzle brake as set forth in claim 1, where approximately 10% to 70% of the area of the inside surface of the tube is inlet openings to the multiple holes per unit length of the tube.

4. A muzzle brake as set forth in claim 1, where the holes in the tube have a semi-circular cross-sectional shape.

5. A muzzle brake as set forth in claim 4, where the holes have a major dimension between approximately one inch and approximately four inches (approximately two-and-a-half to five centimeters).

6. A muzzle brake as set forth in claim 1, where pairs of openings in the inside surface of the side wall are diametrically opposed.

7. A muzzle brake as set forth in claim 1, where the rear end of the tube includes means for securing the muzzle brake to a muzzle end of a gun barrel.

8. A muzzle brake as set forth in claim 7, where the securing means includes a threaded portion of the tube that mates with a corresponding threaded portion on a gun barrel.

9. A muzzle brake as set forth in claim 1, where the inside diameter of the tube is substantially constant between the rear end and the forward end of the tube.

10. A muzzle brake as set forth in claim 1, comprising means for redirecting gas flow and shock waves from a path of the projectile parallel to the axis of the tube toward one or more of the holes.

11. A muzzle brake as set forth in claim 10, where the redirecting means includes one or more protrusions that extend from an inside surface of the side wall of the tube toward the axis of the tube.

12. A muzzle brake as set forth in claim 10, where the flow-redirecting protrusions have a triangular cross-sectional shape.

13. A muzzle brake as set forth in claim 10, where the hole defines a path for propellant gases and shock waves to exit the tube, the redirecting means includes rearward-facing surfaces, and all the rearward-facing surfaces that intersect the path face away from the hole such that any shock waves exiting the hole cannot reflect back into the hole.

14. A muzzle brake as set forth in claim 1 where the side wall of the tube has a substantially smooth inside surface.

15. A muzzle brake as set forth in claim 1, where the side wall of the tube has a substantially smooth inside surface that is interrupted by flow-redirecting protrusions that extend from the inside surface toward the axis of the tube to redirect gas flow and shock waves from a path parallel to the longitudinal axis toward one or more of the holes.

16. A muzzle brake as set forth in claim 15, where the flow-redirecting protrusions extend approximately 0.1 inch (approximately 0.25 centimeter) to approximately 0.5 inch (approximately 1.3 centimeters) from the inside surface toward the axis of the tube.

17. A muzzle brake as set forth in claim 1, where the deflector vane is curved about an axis transverse the longitudinal axis to present a rearward-facing concave surface facing the adjacent hole.

18. A shock reduction muzzle brake comprising (a) a tube that defines a path for a projectile, the tube having a longitudinal axis extending from a rear end to a forward end, the tube defining a side wall extending between the rear end and the forward end, and (b) multiple forwardly-inclined holes, each hole having an axis that has an angle of less than 90° relative to the longitudinal axis as measured on the forward side of the hole, the holes extending through the side wall; where (i) the side wall of the tube has a substantially smooth inside surface that is interrupted by flow-redirecting protrusions to redirect gas flow and shock waves from a path parallel to the longitudinal axis toward one or more of the holes, the protrusions extending approximately 0.1 inch (approximately 0.25 centimeter) to approximately 0.5 inch (approximately 1.3 centimeters) from the inside surface toward the axis of the tube; (ii) where the side wall of the tube includes approximately one hole per inch (approximately two-and-a-half centimeters) of length of the tube to approximately one hole per six inches (approximately fifteen centimeters) of length of the tube; and (iii) where the side wall of the tube has approximately 10% to 70% of inlet openings to the holes per unit length of the tube.

19. A muzzle brake as set forth in claim 18, where the deflector vane is curved about the axis of the deflector vane to present a concave surface facing the adjacent hole.

20. A shock reduction muzzle brake comprising means for guiding a projectile along a linear path, the guiding means including a tube having a side wall that defines a passage with a longitudinal axis extending from a rear end to a forward end, means for venting gases from the path of the projectile, the venting means including multiple forwardly-inclined holes extending from an inside surface of the side wall to an outside surface along an axis that has an angle of less than 90° relative to the longitudinal axis of the tube as measured on a forward side of the axis of the hole, and means for redirecting gas flow to generate a force to counteract a recoil force generated by launching a projectile from the tube without reflecting shock waves back into the path of a projectile, the redirecting means including a rearwardly-facing surface extending outwardly from the outside surface of the side wall on a forward side of the hole, the rearwardly-facing surface extending generally along an axis that has an angle of 90° or less relative to the longitudinal axis of the tube as measured on the forward side of the axis of the rearwardly-facing surface and the axis of the rearwardly-facing surface intersecting the axis of the hole at an angle that is less than 90° as measured on a side toward the outside surface of the side wall so that the rearwardly-facing surface faces outwardly to reflect gases and shock waves exiting the hole away from the hole.

* * * * *